United States Patent [19]

Junghanns et al.

[11] 4,033,564

[45] July 5, 1977

[54] CRUCIBLE FOR MELTING, HEAT RETENTION AND POURING OF METALS

[75] Inventors: Paul Junghanns; Friedhelm Bürger, both of Heiligenhaus, Germany

[73] Assignee: Wilh. Engstfeld, a Kommanditgesellschaft, Heiligenhaus, Germany

[22] Filed: Feb. 5, 1976

[21] Appl. No.: 655,516

[30] Foreign Application Priority Data

Feb. 6, 1975 Germany ..... 2504918

[52] U.S. Cl. ..... 266/242; 432/157; 432/209; 432/211

[51] Int. Cl.² ..... F27B 14/02; F27B 14/06

[58] Field of Search ..... 266/242; 432/156, 157, 432/209, 210, 211

[56] References Cited

UNITED STATES PATENTS

| | | | |
|---|---|---|---|
| 1,366,135 | 1/1921 | Speirs | 266/242 X |
| 1,404,615 | 1/1922 | Kemp et al. | 432/210 X |
| 1,517,324 | 12/1924 | Turnbull | 432/209 X |
| 2,137,040 | 11/1938 | Woodson | 432/209 |

*Primary Examiner*—Ronald J. Shore
*Assistant Examiner*—Gus T. Hampilos
*Attorney, Agent, or Firm*—Martin A. Farber

[57] ABSTRACT

A crucible for melting, and particularly for heat retention and pouring of metals, in particular light metal- or zinc- alloys, with a heat source arranged inside of the melt. A heat source tube extends in a bridge-like manner between the crucible walls, with heating elements entering from a front end of the heat source tube.

12 Claims, 4 Drawing Figures

CRUCIBLE FOR MELTING, HEAT RETENTION AND POURING OF METALS

The invention relates to a crucible for melting, and particularly for heat retention and pouring of metals, in particular light metal- or zinc- alloys, with a heat source arranged inside of the melt.

Particularly for aluminum alloys considerable difficulties occur with the construction of suitable crucibles. The use of good heat conducting cast-iron curcibles for example, are metallurgically very disadvantageous since aluminum corrodes and dissolves iron; a very high maintenance expense and insulation expense must be met.

With the use of ceramic crucibles, which indeed are advantageous, the heat transfer is however problematic. An outside heating with the stamped ceramic crucibles is not possible due to the poor heat conduction. Directly on the metal bath, radiated heat is strongly reflected and added-on or built-in induction channels cause increased oxide formation.

A crucible known from German laid-open publication, Offenlegungsschrift 1,937,946, attempts to solve the described heating problems by the use of a heating gas current. There, a heat conducting, yet refractory fire-proof pot is inserted in the interior space of the crucible. The melt surrounds this pot, whereby the melt surface has to end below the edge of the mouth of the pot. Above the pot there is arranged a high pressure gas-air burner originating from the crucible cover, the burner blowing a hot gas stream into the pot with high speed, in order to heat the jacket surface of the pot. The hot gas stream is then diverted again upwardly from the bottom of the pot which acts as a reflection surface and discharges over the pot edge in the free crucible range above the melt, whereby it sweeps over the melt surface and then discharges through openings from the crucible.

This solution brings, however, smelting technologically, no satisfactory result, and beyond this is exceptionally expensive in production. For example, an extremely stable connection must be provided between the bottom of the pot and the crucible bottom, since the buoyancy of the pot in the melt is very great. In this manner, a free and uniform circulation of the melt is hindered in tbe crucible such that non-uniform heating of the melt results. Moreover the mouth edge of the pot must project from the melt so that the melt surface is penetrated and broken. Besides the non-uniform heating, the disadvantage still occurs that the hot gas striking across the melt during the discharge can lead to an increased oxide formation. Furthermore this crucible can not be formed as a pivoting crucible due to its open pot and it is thus also unfavorable from a pouring technique viewpoint.

It is an object of the present invention, especially in additional to those objects which may be gathered from the specification and claims, to provide a crucible of the introductory mentioned type in a simpler production technological manner which is advantageous in service, by which with optimum uniform heating of the melt not only is a non-hindered circulation with a closed melt surface possible, but rather also beyond that the oxide formation is held low and it is possible to form the crucible as a pivotable crucible, wherein moreover the heating device is closed, and if need be, even filled crucibles are freely accessible, for example for repair work.

This object is solved in accordance with another object of the invention by providing a heat source tube extending in a bridge-like manner between the crucible walls with heating elements entering from the front end of the tube. Other objects are to provide the advantageous additional cooperative features of the dependent claims.

As a result of such embodiments, a crucible of the introductory mentioned type is provided of increased serviceability. For a uniform heating of the melt, the crucible in accordance with the invention requires no additional blowing device or apparatus originating or extending from the crucible cover. The cover of the crucible as well as the melt surface can be completely closed such that for reduction of the oxide formation, in an advantageous manner, protective gas can be applied; in spite of the use of a metallurgical advantageous ceramic-inner casing of the crucible, a good gas impermeability is provided in connection with an outermost disposed ferrocladding, which is necessary for pouring with reduced pressures (partial vacuum). Since the heat source tube which bridge-like connects the opposite walls of the crucible, freely passes through the melt, an optimum utilization of the heating surface is provided since the complete jacket or shell surface of the heat source tube is in operative effect. Also, neither the surface of the melt is pierced nor are holding means for the heat source tube provided which extend from the bottom, so that the melt can freely circulate in the crucible about the heating tube, and in this manner an exceptionally uniform heating is experienced. The type of heating can thus be selected in any optional way: It is possible to use electro-resistance heating, as well as induction heating or burner heating, for example. The free face ends of the heat source tube are thus held by flange plates on the outer sides of the crucible, with insertion in corresponding bores in the crucible, which flange plates have guide through openings for example for electrical heating source elements. The heating elements are thus freely accessible from the outside of the crucible, whereby possible necessary repairs can be carried out even with the filled crucible. Moreover by means of the advantageous assembling from the outside, with regard to the metal to be used at the time in the crucible, the possibility results to use a metallurgically favorable or compatible heat source tube. As a consequence of the easy exchangability of the heat source tube, the crucible can be completely integrally constructed as a unit, and only the heat source tube, if necessary, can be exchanged. Here, for example with aluminum melts, heat source tubes made of SiC or silicon carbide may be used, whereas for example with zinc alloys, cast iron may be used. The heat source tube is thus in a favorable manner not directly connected with the outside disposed flange plates, but rather via the interpositioning of stopper- or plug-like coupling pieces. These stoppers project with the interpositioning of seals made of suitable material into the heat source tube which is freely carried thereby radially spaced relative to the crucible bore, such that the therewith connected different material expansions have a sufficient adjustment play space. The easy to damage ceramic inner casing remains in this manner free of the thermal expansion forces which occur. Moreover by the seals practically freely carrying the heat source tube, a direct connection, that is direct heat transfer, for example of the electrical heating rods on the material in avoided. The heating of the heat source tube-jacket shell takes place merely by the uniform heat radiation of the heating rod section which is freely inserted through the tube. In this manner not only are uniform temperatures guaranteed in the entire surface range of the heat source tube-jacket, but also beyond that a heating therewith of the outer disposed flange plates if prevented. The applied heat energy is thus purposefully used in an optimum manner without any losses worth mentioning. The outer lying flange plates are arranged in lateral recesses in the outer wall of the crucible such that the constructional form of the crucible does not have to be unnecessarily enlarged. The advantages obtained by the favorably arranged heat source tube are yet reinforced by suitable formation of the bottom of the melt or pouring crucible. This bottom is formed arched in the longitudinal plane of the heat source tube, whereby the heat source tube lies substantially centrally relative to the arch curve, at least in the normal or ground position of the crucible under the axis of the crucible, the axis lying substantially in the range of the pouring spout. In this manner, not only is there guaranteed that the molten surface always remains above the heat source tube in a favored tipping range, but also by a suitable advantageous formation of the shape of the cross-section of the crucible it is achieved even in the pouring position that no section of the heat source tube-jacket surface lays bare. In this manner, on the one hand, the melt surface remains always closed or unbroken, and on the other hand, the upper surface is approximately held equal, whereby a break of the casting skin is prevented. The cross-sectional shape of the crucible which is wedge-shaped toward the bottom as well as toward the pouring spout, results beyond this, in smaller swinging movements during tipping of the crucible for the pouring by reducing the pouring capacity or melting contents. Thereby, the melts, with respect to the pouring, can be utilized up to a relatively small residual quantity.

With the above and other objects in view, the invention will become more clearly understood in connection with the detailed description of a preferred embodiment in connection with the accompanying drawings, of which:

Figure 1:
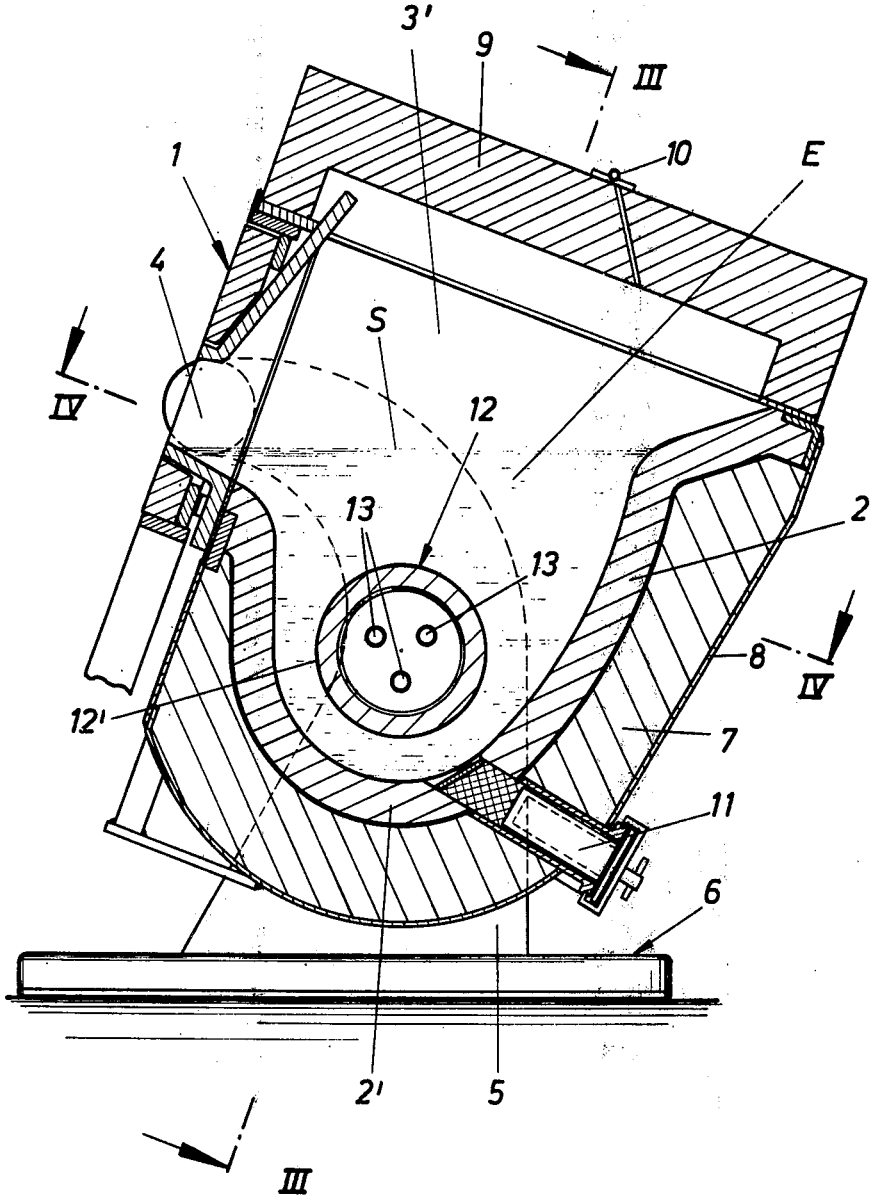
FIG. 1 is a longitudinal lateral cross-sectional view through a crucible in accordance with the present invention in the normal or ground position.
Figure 2:
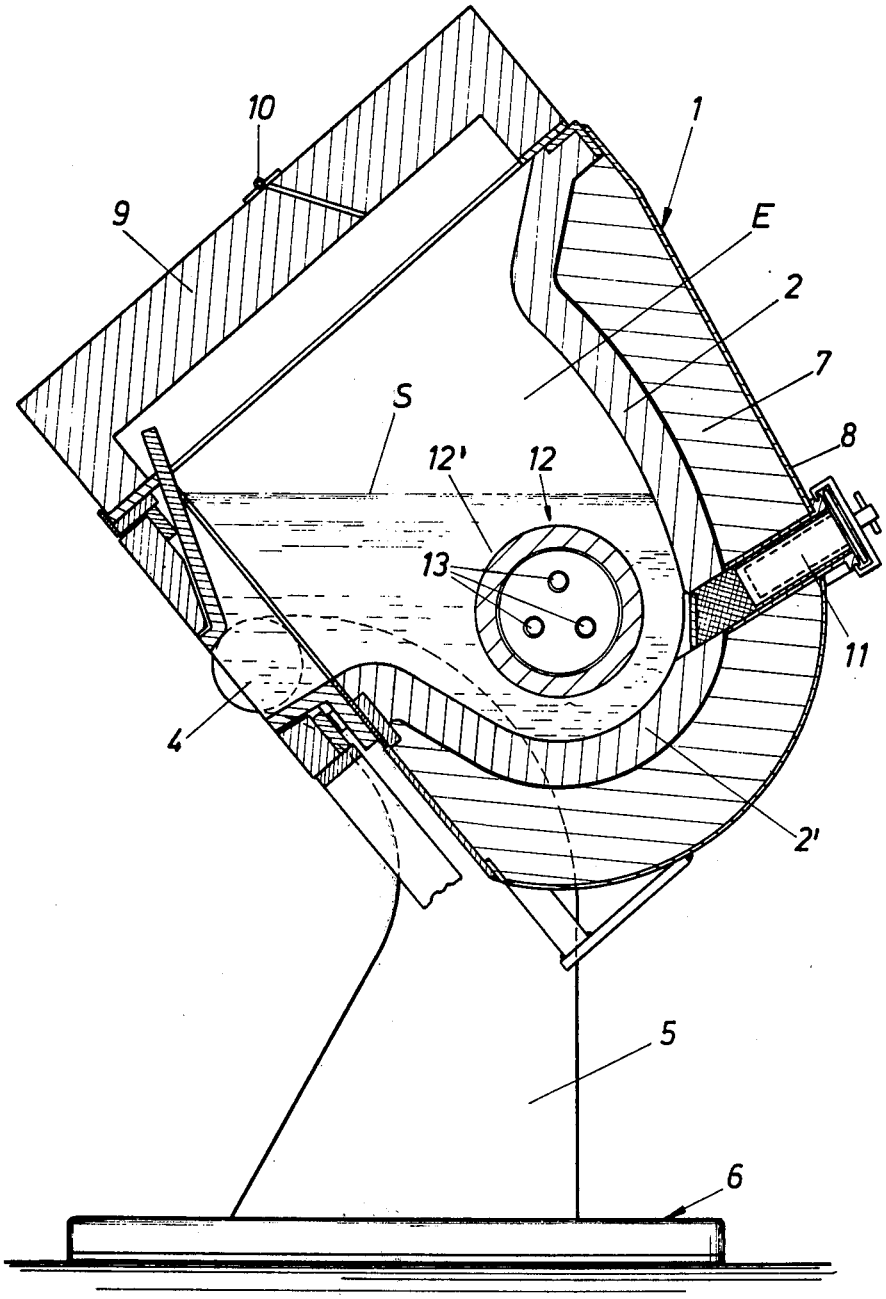
FIG. 2 is a corresponding view of the crucible of FIG. 1 in the pouring position.
Figure 3:
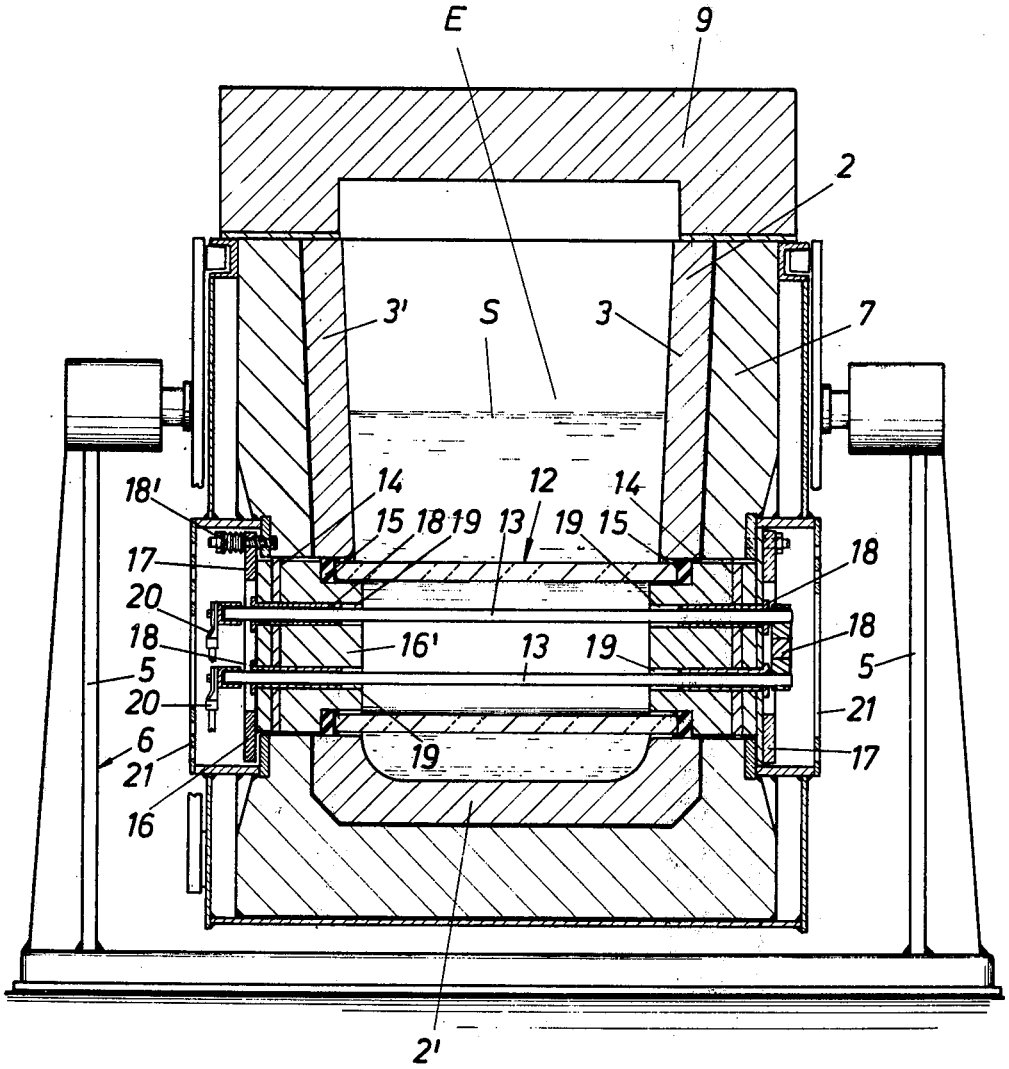
FIG. 3 is a section taken along the lines III — III of FIG. 1.
Figure 4:
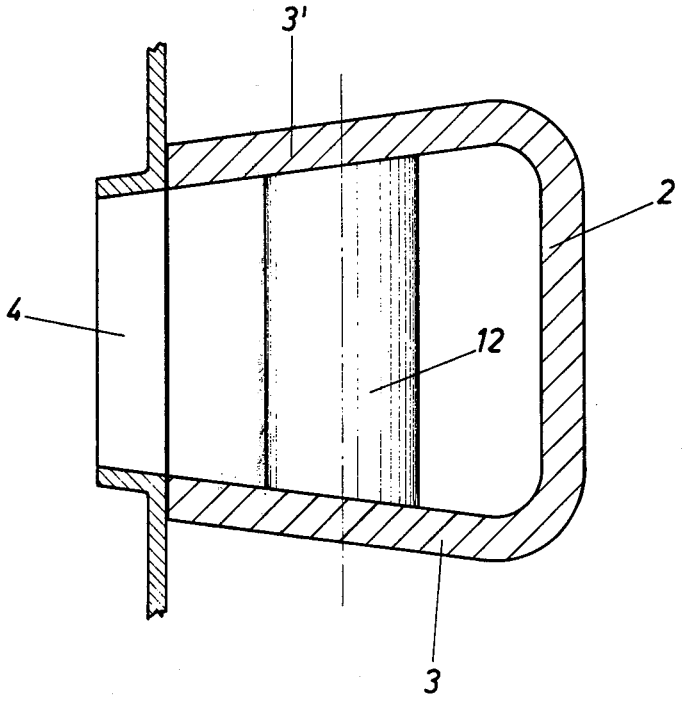
FIG. 4 is a cross-sectional view through the inner casing, taken along the lines IV — IV of FIG. 1.

Referring now to the drawings, the crucible 1 according to the invention has a pot-shaped melting- or heat retaining-space E for the smelt or molten material S. The pot is formed of a relatively thin walled metallurgically advantageous ceramic-inner lining or casing 2. The side walls 3, 3′ extend therewith converging toward a curved channeled bottom 2′, as well as converging toward a front sided pouring spout 4.

In the range of the pouring spout 4, the crucible 1 is pivotally fastened on carrier arms 5 of a base stand 6, so as to be tipped about a tipping axis adjacent the spout 4.

The heat insulating inner casing 2 of the crucible is surrounded by a reinforcing stronger material comprising a thicker outer wall 7, which likewise is of heat insulating material, and which furthermore, for the impermeability of gas of the inner space E, is encased by a sheeting 8.

At the top, the crucible is closed by a cover 9. The cover is formed in two parts articualted by means of a hinge 10, in order to facilitate the filling of the crucible 1 with melt.

Moreover the bottom range 2′ of the crucible is provided with a drain opening 11 through which, if necessary under certain circumstances, residual smelt in the crucible 1 can be discharged or drained.

For the uniform heating of the melt in the crucible, there is provided a heat source tube 12 which in the illustrated example can be heated by means of electrical heating rods 13, or yet also by an induction coil or burner, a heated filament or the like.

The heat source tube 12 extends in a bridge-like manner freely between the side walls 3, 3′ of the crucible 1 and lies substantially centrally and concentrically relative to the curved channeled bottom 2′ of the inner casing 2.

The outer jacket 12′ of the heat source tube 12, for aluminium-melts, is made of good heat insulating and metallurgically favorable silicon-nitride, since the latter is not wettable. Silicon-nitride is best suited for the outer jacket 12′ in this case.

The heat source tube 12 is inserted from the outside through corresponding openings 14 in the side walls 3, 3′, which openings also extend through the outer wall 7 of the crucible 1.

The face sided end sections of the tube 12 are carried by means of the interpositioning of annular seals 15 which are made of suitable material, the seals being disposed on the smaller cross-section carrier sections 16′ of plugs or stoppers 16, and engage the crucible and the ends of the tube 12. The seals 15 thus not only seal the smelting space to the outside with respect to the passing-through openings 14, but also hold the tube 12 radially spaced relative to the bearing or support sections 16′ of the stoppers 16 and relative to the openings 14. In this manner, a co-heating of the stoppers and thus a heat loss are prevented and necessary free volume is provided for the thermal expansion of the tube 12.

The stoppers are fixed on the crucible 1 by means of outer flange plates 17 arranged in recesses in the outer walls. Securing screws 18′ for the flange plates 17 are thereby formed shock absorbing or spring equipped in order to equalize or balance any axial expansion or enlargement of the tube 12. The mounting of the electric heating rods 13 serving for the heating and used in the embodiment example herein, is provided further by interpositioning of heat insulating bushings or bearings 18 in guide openings or bores 19 which pass through the stoppers 16.

The corresponding electric connections or terminals 20 of the heating rods 13 lie outside of one of the flange plates 17, and both flange plates 17 are additionally surrounded by a protective housing 21.

The thus formed crucible brings about an exceptionally uniform heating of the melt with optimum efficiency and distribution of the heat energy with the possibility of free circulation of the melt.

While we have disclosed several embodiments of the invention, it is to be understood that these embodiment examples are given by illustration only and not in a limiting sense.

We claim:

1. A crucible for melting, heat retention and pouring of metals, in particular light metal- or zinc- alloys, comprising a crucible having crucible walls and adapted to hold a melt therein, heat source means operatively arranged within the melt for heating the melt comprising, a completely peripherally closed heat source tube having ends, said heat source tube extending bridge-like between said crucible walls, electrical heating elements entering from at least one of said ends of said tube and passing therethrough, stoppers closing said ends, respectively, of said heat source tube, said stoppers being formed with longitudinal carrier openings passing therethrough, said electrical heating elements extend through said carrier openings, outer flange plates outwardly supporting and covering said stoppers, respectively.

2. The crucible, as set forth in claim 1, wherein said crucible has an outer wall, flange plates close said ends, respectively, of said heat source tube, said flange plates are operatively engaged in sealing position relative to said outer wall of said crucible, said flange plates are formed with guide through openings, said heating elements pass through said openings.

3. The crucible, as set forth in claim 2, wherein said outer wall of said crucible is formed with lateral recesses, said flange plates are arranged in said lateral recesses of said outer wall of said crucible.

4. A crucible for melting, heat retention and pouring of metals, in particular light metal- or zinc- alloys, comprising a crucible having crucible walls and adaped to hold a melt therein, heat source means operatively arranged within the melt for heating the melt comprising, a heat source tube having ends, said heat source tube extending bridge-like between said crucible walls, heating elements entering from at least one of said ends of said tube, said crucible including an inner casing, said ends, respectively, of said heat source tube, lie substantially in a range of said inner casing of said crucible, flange plates operatively engaging said crucible walls, stoppers closing said ends of said tube and are disposed inner - sided relative to and between said flange plates, said heat source tube being cross-sectionally larger relative to said heating elements, said stoppers being formed with guide openings therethrough, said heating elements pass through said guide openings.

5. The crucible, as set forth in claim 4, wherein said stoppers have a smaller cross-sectional section inserted in said ends, respectively, of said heat source tube, annular seals disposed on said smaller cross-sectional sections of said stoppers, said seals carry said ends, respectively, of said heat source tube spaced from said sections and sealingly abut said inner casing of said crucible.

6. The crucible, as set forth in claim 1, wherein said crucible includes a bottom having an arched surface, said heat source tube is disposed substantially centrally relative to said arched surface of said bottom of said crucible.

7. The crucible, as set forth in claim 1, wherein said crucible is formed with a pouring spout, means for pivotally mounting said crucible about a tipping axis substantially in a range of said pouring spout, said heat source tube is disposed below said tipping axis in a ground position of said crucible.

8. The crucible, as set forth in claim 1, wherein said crucible is formed with a pouring spout, said crucible walls carry said ends of said heat source tube, said crucible walls converge relative to each other in a direction of said pouring spout, and said crucible walls diverge upwardly at least in a range above said heat source tube.

9. A crucible for melting, heat retention and pouring of metals, in particular light metal- or zinc- alloys, comprising a crucible having crucible walls and adaped to hold a melt therein, heat source means operatively arranged within the melt for heating the melt comprising, a heat source tube having ends, said heat source tube extending bridge-like between said crucible walls, heating elements entering from at least one of said ends of said tube, stoppers closing said ends, respectively, of said heat source tube, outer flange plates outwardly engaging said stoppers therebetween, said flange plates being axially resiliently moveably mounted on said crucible walls, respectively.

10. The crucible, as set forth in claim 9, wherein said flange plates are mounted in sealing position relative to said crucible walls, respectively.

11. The crucible, as set forth in claim 9, further comprising spring mounted securing screws axially mounting said flange plates to said crucible walls, respectively.

12. The crucible, as set forth in claim 1, further comprising heat insulating bushings disposed on said electrical heating elements in said carrier openings in said stoppers.

* * * * *

UNITED STATES PATENT AND TRADEMARK OFFICE

CERTIFICATE OF CORRECTION

PATENT NO. : 4,033,564

DATED : July 5, 1977

INVENTOR(S) : Paul Junghanns; Friedhelm Bürger

It is certified that error appears in the above-identified patent and that said Letters Patent are hereby corrected as shown below:

CLAIM 2:

Column 5, Line 23 before "flange" --said-- should be inserted

Column 5, Line 28 after "said" --guide through-- should be inserted

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*